US005377733A

United States Patent [19]

Halley et al.

[11] Patent Number: 5,377,733

[45] Date of Patent: Jan. 3, 1995

[54] STORAGE APPARATUS FOR CARDS

[76] Inventors: Michael A. Halley, 7538 Hagen Ct., Hamilton, Ohio 45011; John M. Neuhart, 7689 Athenia Dr., Cincinnati, Ohio 45244

[21] Appl. No.: 216,612

[22] Filed: Mar. 23, 1994

[51] Int. Cl.[6] ..... A45C 11/18

[52] U.S. Cl. ..... 150/147; 206/455

[58] Field of Search ..... 206/455, 472, 473; 150/147, 149, 145, 148, 133; 294/16, 25, 33

[56] References Cited

U.S. PATENT DOCUMENTS

| | | | |
|---|---|---|---|
| 685,333 | 10/1901 | Hunter . | |
| 1,463,619 | 7/1923 | Gardner . | |
| 1,585,051 | 5/1926 | Skoglund . | |
| 1,832,625 | 11/1931 | Gardner, Jr. . | |
| 1,899,311 | 2/1933 | Cassell . | |
| 2,020,797 | 11/1935 | Pabst, Jr. . | |
| 3,558,169 | 1/1971 | Onanian | 294/33 |
| 4,226,459 | 10/1980 | Natalicio | 294/33 |
| 4,322,001 | 3/1982 | Hurley . | |
| 4,848,576 | 7/1989 | Stemmer, Jr. | 206/455 |
| 4,974,983 | 12/1990 | Givati . | |
| 5,020,255 | 6/1991 | Rodel . | |
| 5,119,574 | 6/1992 | King . | |
| 5,159,964 | 11/1992 | Baker et al. . | |

*Primary Examiner*—David T. Fidei
*Attorney, Agent, or Firm*—Steven J. Rosen

[57] ABSTRACT

A card storage system for storing a sport or other collectible card in a pocket with a tool having a thin flat insertion panel including a width smaller than the opening of the pocket and longitudinally extending side edges and a front end generally transversely extending between the side edges. Longitudinally extending flanges having tapered forward ends extend upwards from a front side of the tool along corresponding ones of the side edges forming a channel between the flanges. A tapered edge, preferably having a narrowing width in the longitudinal direction, is provided at the front end of the insertion panel for spreading apart the opening of the pocket. A longitudinally extending flat extraction panel is connected to the insertion panel's back end and provided with a tapered edge at its front end which is itself of narrowing width for spreading apart the opening of the pocket to extract the card from the pocket.

16 Claims, 2 Drawing Sheets

STORAGE APPARATUS FOR CARDS

FIELD OF INVENTION

The present invention relates generally to the field of storing baseball, football, basketball and other collectible cards, and more specifically to an apparatus and system for inserting and extracting the collectible cards into and from a protective envelope, while preventing damage to the corners, edges, or faces of the cards.

BACKGROUND OF THE INVENTION

A variety of card storage systems for storing collectible cards in envelopes or pockets to protect the cards from dust, dirt and physical damage are found in the prior art. They are typically made of a transparent plastic such as polyethylene for ready viewing and identification of the cards they contain and are often arranged as pockets on a sheet or page that can be held in bound or loose leaf or other types of binders. However, the cards the corners, edges, and face surfaces; of the collectible cards are subject to damage during the storage processes of insertion and extraction into and from the protective envelopes or pockets. The limited pocket size and general nature of clear plastic pages can cause inadvertent damage when manually inserting or extracting cards from pockets. Manual insertion and insertion can sometimes be very difficult and frustrating as well as time consuming, which can increase the chance of bending or nicking a corner and creasing or tearing a trading card. This can cause a great decrease in the value of a collectible card; for example a damaged corner or edge can result in a 50 percent reduction in the value of a collectible card. Therefore, there has been a need for a means to insert and extract the cards in and from the envelope without damaging its edges or corners.

U.S. Pat. No. 5,159,964, by Baker et al., proposes a cover in the form of tong like tool to protect the cards (only during the insertion process) in the form of a tool having two substantially parallel flexible panels having widths shorter than the envelope width and being resiliently spaced from each other at their free ends. The card may be grasped between the panels for insertion into the envelope and notches are provided in the free ends of the panel to permit gripping the card between the walls of the envelope when the tool is withdrawn. The Baker tool must be loaded with a card and does not provide for the extraction of the card. Its tong like design presents a very thick edge to the opening of the pockets which makes it somewhat difficult to spread apart and open the pockets particularly in the case of tighter fitting pockets made of thinner plastic or polyethylene.

Another problem associated with using plastic such as polyethylene pockets is that the collectible cards may become stuck to the front or back sides of the pocket and a safe means to remove the card is required in order to prevent or reduce as much as possible the amount of damage to the card.

OBJECTS OF THE INVENTION

It is thus an object of the present invention to provide a tool and method which permits insertion and extraction of cards without damage to their corners, edges, or faces which will cause the value of the collectible card to be significantly decreased.

It is another object of the present invention to provide such a tool as described above which is compact and inexpensive and easy to use with a variety of card storage envelopes and pockets.

Yet another object of the present invention is to provide a safe means to remove a card that may become stuck to the front or back sides of a pocket with a minimal amount of damage to the card.

It is finally an object of the present invention to provide such a tool which is specifically suited for protecting any collectible card during the insertion and extraction process into an envelope.

SUMMARY OF THE INVENTION

A card storage system for storing a card, or any thin flat sheet or card like element, in a longitudinally extending pocket with an opening at an end of the pocket provides a tool having a longitudinally extending flat insertion panel including a width smaller than the opening of the pocket and longitudinally extending side edges and a front end generally transversely extending between the side edges. Longitudinally extending flanges having tapered forward ends extend upward from a front side of the tool along corresponding ones of the side edges forming a channel between the flanges. A tapered edge, preferably having a narrowing width in the longitudinal direction, is provided at the front end of the insertion panel for spreading apart the opening of the pocket.

In one embodiment each of the flanges has a front section and back section that correspondingly extend a front height and a back height upward from the front side wherein the back height is larger than the front height. In the preferred embodiment the card storage system tool is further provided with a longitudinally extending flat extraction panel having longitudinally extending side edges, an extraction panel back end, and an extraction panel front end. The extraction panel back end is connected to the insertion panel back end, preferably by a hinge means for allowing one of the panels to be folded over onto the other of the panels. A tapered edge is provided at the extraction panel front end which is itself of narrowing width for spreading apart the opening of the pocket. The tool preferably has a back side with a textured gripping surface along the extraction panel and can be molded from a flexible plastic material.

DESCRIPTION OF THE INVENTION

Figure 1:
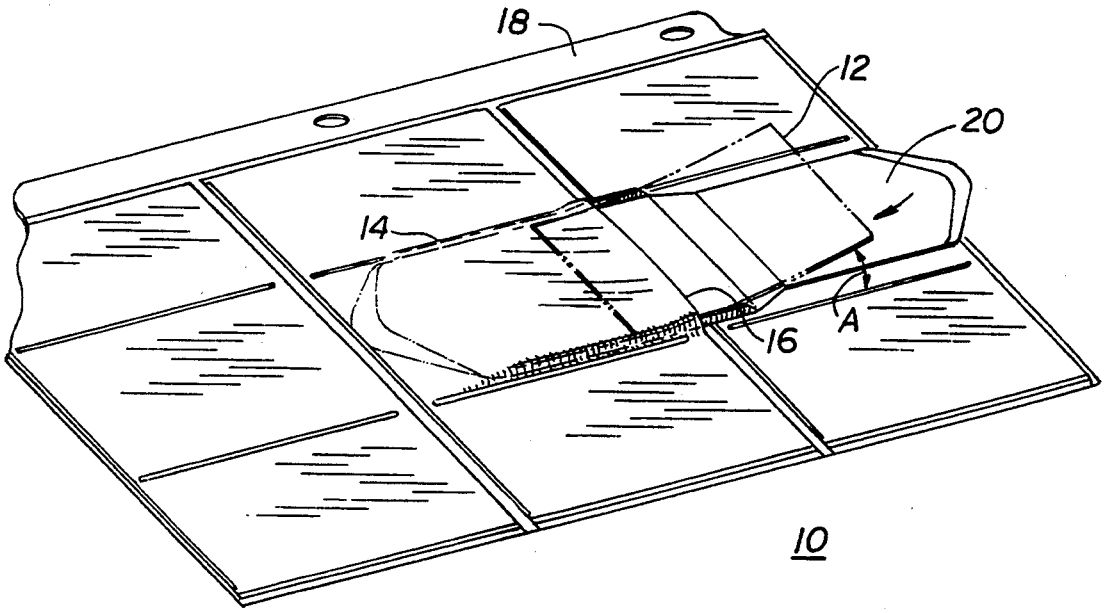
FIG. 1 is a perspective view illustrating a card storage system incorporating the tool of FIG. 1 in accordance with one embodiment of the present invention.

FIG. 1 illustrates a card storage system 10 for storing a card 12 in a longitudinally extending pocket 14 with an opening 16 and includes a tool 20 in accordance with the preferred embodiment of the present invention. The pocket 14 is illustrated on a sheet or page 18 of pockets that can be held in bound or loose leaf or other types of binders but the invention is also applicable to single pockets that may be used to store cards.

Figure 2:
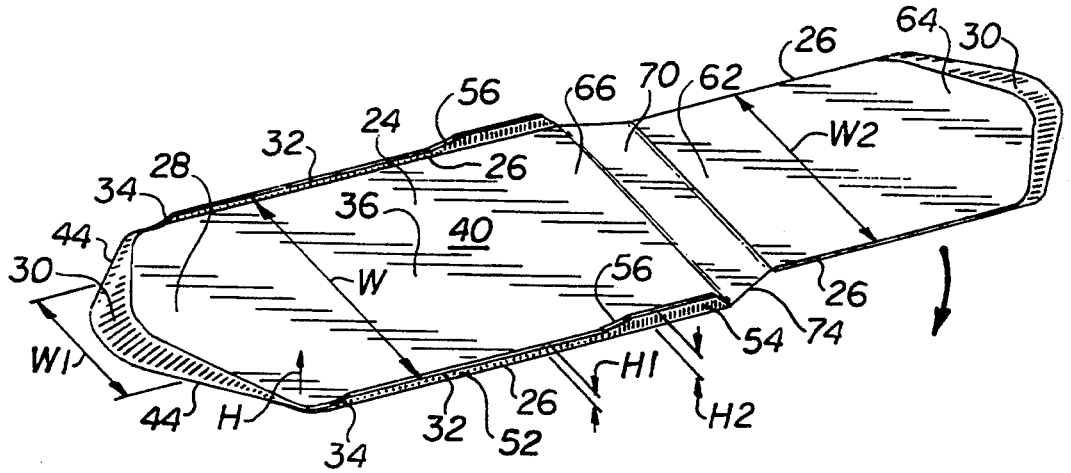
FIG. 2 is a more detailed perspective view of the tool in FIG. 1.

The tool 20, illustrated in greater detail in FIG. 2, has a longitudinally extending flat insertion panel 24 and an outside width W slightly smaller than the width of the opening 16 of the pocket: 14 in FIG. 1. The insertion panel 24 has longitudinally extending side edges 26 and a front end 28 generally transversely extending between the side edges. Longitudinally extending flanges 32, having tapered forward ends in the form of wedges 34, extend upward a height H, on the order of magnitude of about 40 mils, from a front side 36 of the tool 20 along corresponding ones of the side edges thereby forming a channel 40 between the flanges.

The front end 28 has a tapered edge 30 and side portions 44 which are angled or cut back with respect to the side edges 26. The tapered edge 30 may also be cut back or curved in some other manner in order to provide a front end of narrowing width W1. The shape of the front end 28 with the cut back side portions 44 and the tapered edge 30 provide a means for easily inserting the tool into the pocket 14 and the wedges 34 provide a means to easily initiate the opening of the pocket's opening 16. Following the initial opening the rest of the insertion panel 24 can be slid in so that the flanges 32 can spread open the pocket 14 to allow the unobstructed insertion of the card 12 into the pocket through the channel 40.

Preferably, each elf the flanges 32 has a front section 52 and a back section 54 that correspondingly extend a front height H1 and a back height H2 upward from the front side 36 wherein preferably the back height is about twice as large as the front height. A second wedge 56 transitions each of the flanges 32 from the front section 52 to back section 54. The second wedge 56 and higher back section 54 allow the pocket opening 16 to be opened a bit wider to further facilitate insertion of the card 12 at a larger insertion angle A reducing the risk of nicking a corner or scraping the edge of the card 12. The ability to allow the card 12 to be inserted at a larger angle A also helps prevent bending the card which could mar the face of the card or crease it.

Figure 3:
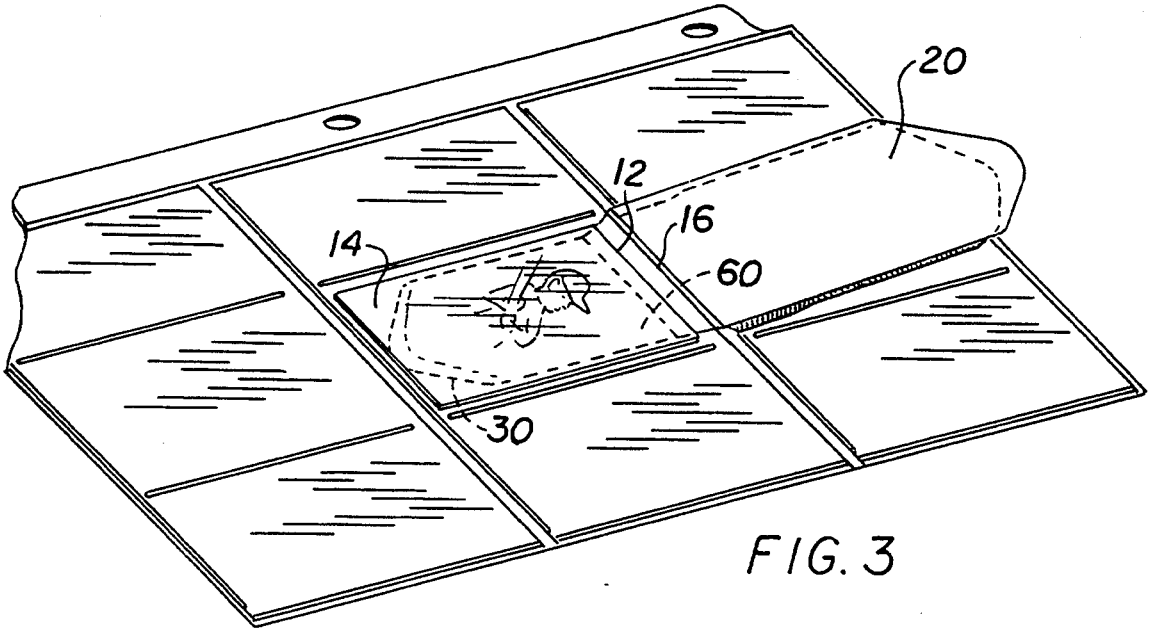
FIG. 3 is a perspective view illustrating the usage of a card extraction feature of the tool in FIG. 2.
Figure 3A:
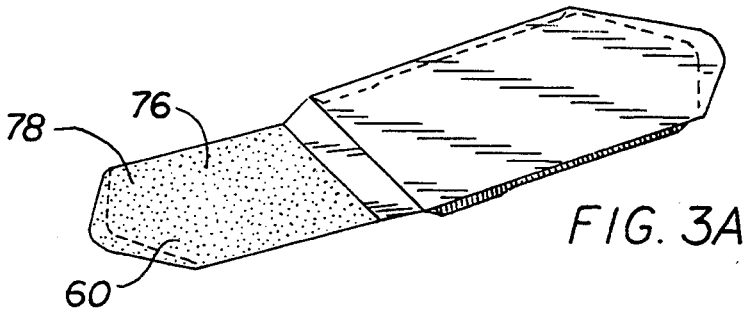
FIG. 3A is an upside down perspective view of the tool in FIG. 2.

Referring to FIGS. 2, 3, and 3A, the exemplary embodiment of the tool 20 further includes a longitudinally extending flat extraction panel 60 having longitudinally extending side edges 26 and a second width W2 that is smaller than that of the opening 16 and preferably smaller than the width W of the insertion panel 24. An extraction panel back end 62 may be operably connected to an insertion panel back end 66 of the insertion panel 24 as illustrated, The extraction panel 60 also includes an extraction panel front end 64 having an extraction tapered edge 30 at the extraction panel front end 64 for spreading apart the opening 16 of the pocket 14, as illustrated in FIG. 3A, during the card extraction process. The tapered edge 30 at the extraction panel front end 64 allows the extraction panel 60 to be easily slid between the card 12 and the pocket 14 and also helps separate the card from the pocket if they are sticking to each other. The tool 20 and in particular the extraction panel 60 is provided with a textured gripping surface 76 on the tool's backside 78 to help the extraction panel grip the card 12 during the card extraction process. The textured surface 76 may be provided by roughening a portion of the backside 78 or making it fuzzy or some other suitable material or treatment may be applied to the backside.

Figure 4:
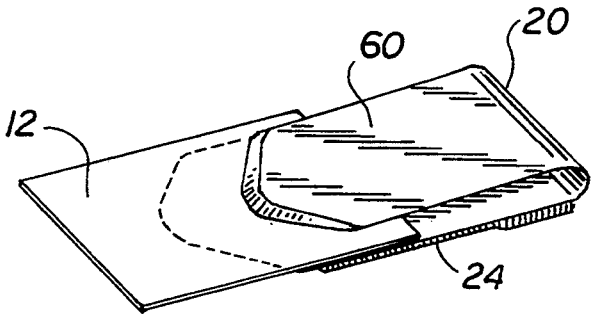
FIG. 4 is a perspective view illustrating the usage of the tool in FIG. 2 as a pair of tongs for handling the card.

Referring back to FIG. 2, the extraction panel back end 62 is connected to the insertion panel back end 66 by a hinge or other means 70 for allowing one of the panels to be folded over onto the other panel. The tool 20 is preferably formed of a single sheet of plastic and the hinge means 70 can be formed by constructing a set of spaced apart transversely extending grooves or indentations 72 between the extraction panel back end 62 and the insertion panel back end 66 by forming a third hinge panel 74 between the other two panels. This allows the tool 20 to be used as a pair of tongs, as illustrated in FIG. 4, for handling the card 12 in a safe and efficient manner when the card is outside the pocket 14. This helps prevents marring or soiling the face of the card when handling it.

While the invention has been shown in connection with a preferred embodiment, it is not the intention that the invention be so limited. Rather, the invention extends to all such designs and modifications as come within the scope of the appended claims. For example the invention may be used with any thin flat sheet or card like element such as a photograph.

What is claimed is:

1. A card storage apparatus for storing a card in a longitudinally extending pocket having an opening, said card storage apparatus comprising:

a thin tool having a longitudinally extending flat insertion panel with a panel width smaller than the opening of the pocket, said panel having longitudinally extending side edges and insertion panel front and back ends, at least one longitudinally extending flange having a tapered forward end and extending upward from a front side of said tool along a corresponding one of said side edges, and a tapered edge at said front end for spreading apart the opening of the pocket.

2. A card storage apparatus as claimed in claim 1, wherein said tool further comprises a second longitudinally extending flange having a tapered forward end and extends upward from said front side along a corresponding second one of said side edges forming a channel between said flanges and said insertion panel front end has a narrowing width in a longitudinally extending forward direction.

3. A card storage apparatus as claimed in claim 2, wherein said flange extend upward from said front side a height of about 40 mils.

4. A card storage apparatus as claimed in claim 2, wherein said tool further comprises;

a longitudinally extending flat extraction panel having longitudinally extending side edges, an extraction panel back end, and an extraction panel front end, said extraction panel front end having a narrowing width in a longitudinally extending forward direction, said extraction panel back end connected to said insertion panel back end, and a second tapered edge at said extraction panel front end for spreading apart the opening of the pocket.

5. A card storage apparatus as claimed in claim 4, wherein said extraction panel back end is connected to said insertion panel back end by a hinge means for allowing one of said panels to be folded over onto the other of said panels.

6. A card storage apparatus as claimed in claim 2, wherein each of said flanges has a front section and back section that correspondingly extend a front height and a back height upward from said front side wherein said back height is larger than said front height.

7. A card storage apparatus as claimed in claim 6, wherein said back height is about twice as large as said front height.

8. A card storage apparatus as claimed in claim 5, wherein said extraction panel has a back side with a textured gripping surface.

9. A card storage apparatus as claimed in claim 8, wherein said tool is molded from a flexible plastic material.

10. A card storage system for storing a card, said card storage system comprising:

at least one longitudinally extending pocket having an opening, a tool having a longitudinally extending flat insertion panel with a width smaller than said opening of said pocket, said panel having longitudinally extending side edges and an insertion panel front end and an insertion panel back end, at least one longitudinally extending flange having a tapered forward end and extending upward from a front side of said tool along a corresponding one of said side edges, and a tapered edge at said front end for spreading apart the opening of the pocket.

11. A card storage system as claimed in claim 10, wherein said tool further comprises a second longitudinally extending flange having a tapered forward end and extends upward from said front side along a corresponding second one of said side edges forming a channel between said flanges.

12. A card storage system as claimed in claim 11, wherein said tool further comprises;

a longitudinally extending flat extraction panel having longitudinally extending side edges, an extraction panel back end, and an extraction panel front end, said extraction panel back end connected to said insertion panel back end, a second tapered edge at said extraction panel front end for spreading apart the opening of the pocket, and side portions of said extraction panel front end are cut back with respect to said side edges, said channel has a smooth surface, and said extraction panel has a back side with a textured gripping surface.

13. A card storage system as claimed in claim 12, wherein each of said flanges has a front section and back section that correspondingly extend a front height and a back height upward from said front side wherein said back height is larger than said front height.

14. A card storage system as claimed in claim 13, wherein said back height is about twice as large as said front height.

15. A card storage system as claimed in claim 14, wherein said extraction panel back end is connected to said insertion panel back end by a hinge means for allowing one of said panels to be folded over onto the other of said panels.

16. A card storage system as claimed in claim 15, wherein said tool is molded from a flexible plastic material.

* * * * *